US011419430B2

(12) United States Patent
Magri

(10) Patent No.: US 11,419,430 B2
(45) Date of Patent: Aug. 23, 2022

(54) PARTICULARLY VERSATILE DOUBLE MATTRESS

(71) Applicant: Massimo Magri, Pordenone (IT)

(72) Inventor: Massimo Magri, Pordenone (IT)

( * ) Notice: Subject to any disclaimer, the term of this patent is extended or adjusted under 35 U.S.C. 154(b) by 0 days.

(21) Appl. No.: 16/905,575

(22) Filed: Jun. 18, 2020

(65) Prior Publication Data

US 2020/0397149 A1 Dec. 24, 2020

(30) Foreign Application Priority Data

Jun. 18, 2019 (IT) ..... 102019000009396

(51) Int. Cl.

| | |
|---|---|
| ***A47C 27/10*** | (2006.01) |
| ***A47C 27/15*** | (2006.01) |
| ***A47C 27/00*** | (2006.01) |
| ***A47C 31/10*** | (2006.01) |
| *A47C 27/14* | (2006.01) |

(52) U.S. Cl.

CPC ..... *A47C 27/001* (2013.01); *A47C 31/105* (2013.01); *A47C 27/14* (2013.01)

(58) Field of Classification Search

CPC ..... A47C 27/00; A47C 27/001; A47C 27/062; A47C 27/061; A47C 27/064

See application file for complete search history.

(56) References Cited

U.S. PATENT DOCUMENTS

| | | | | |
|---|---|---|---|---|
| 3,308,492 | A * | 3/1967 | Lovette | A47C 27/001 5/722 |
| 4,231,127 | A * | 11/1980 | Bendell | A47C 27/001 5/722 |
| 4,449,261 | A * | 5/1984 | Magnusson | A47C 21/044 5/722 |
| 5,644,811 | A * | 7/1997 | Cavazos | A47C 31/105 5/721 |
| 6,101,653 | A * | 8/2000 | England | A47C 27/001 5/727 |
| 6,922,863 | B2 * | 8/2005 | Giori | A47C 27/084 5/655.3 |
| 7,454,810 | B2 * | 11/2008 | Wells | A47C 27/056 5/722 |
| 9,131,782 | B1 * | 9/2015 | Baker | A47C 27/062 |
| 2007/0022540 | A1 * | 2/2007 | Hochschild | A47C 27/15 5/727 |
| 2009/0100606 | A1 * | 4/2009 | An | A47C 27/064 5/716 |

OTHER PUBLICATIONS

Oct. 24, 2019 Search Report and Written Opinion issued in Italian Patent Application No. 201900009396 (with partial translation).

* cited by examiner

*Primary Examiner* — Peter M. Cuomo
*Assistant Examiner* — Ifeolu A Adeboyejo
(74) *Attorney, Agent, or Firm* — Oliff PLC

(57) ABSTRACT

A double mattress that is particularly versatile thanks to a structure, which can be modified at any time according to particular needs or preferences, even if these differ between the two sides of the mattress. The book-like structure makes it possible to combine at will both the two different sides and the layers in contact with the body of two individuals with different needs.

13 Claims, 6 Drawing Sheets

PARTICULARLY VERSATILE DOUBLE MATTRESS

TECHNICAL FIELD OF THE INVENTION

The present invention refers to a particularly versatile double mattress whose structure can be modified at any time to meet particular needs or preferences, also in a different way on the two sides of the mattress.

Background Art

In the field of furniture, a variety of structures for single or double mattresses has known for a long, for example, those provided with a central body and two opposing surfaces, the last offering different characteristics to meet different comfort needs. In fact, mattresses quite commonly present a first face made with heat-dispersing material for use during the warm months of the year and a second face made with a heat-retaining material for cold seasons.

In the last years, technologies have been developed wherein at least one face of a mattress is made of materials that allow for firmness control or form-memory materials. This has permitted the provision of products that can satisfy specific needs of people of different body sizes and builds. Indeed, the medical profession has recognized the importance of maintaining correct posture while resting. In addition, important morphological differences exist among men, women and children.

Therefore, all these needs have led mattress producers to develop a wide variety of so-called "personalized" mattresses. However, this has caused an enormous increase in the scale of production because of myriad personal variations, requiring producers to supply different materials, different machinery, complex warehouse management systems, all at a considerable increase in costs.

It should also be mentioned that for facilities such as hotels, hospitals and colleges that regularly host individuals with disparate needs, the problem of management and supply becomes all the more relevant and costly.

These problems are even more evident with double mattresses, which clearly can incorporate in a single structure two zones with differentiated structures.

SUMMARY OF THE INVENTION

The technical problem that led to the present invention is to come up with a double mattress that is provide with a structure able to meet users' needs and preferences without being forced to rely on the many mattresses that have already been produced and "personalized."

The problem has been solved with a highly versatile structure that can quickly and simply change both the degree of heat retention and dispersal and different firmness levels.

A first object of this invention is a double mattress comprising a particularly versatile cover that can contain different filling materials.

A second object is to produce a double mattress adapted to easily and quickly satisfy the needs of two individuals who might be using it at the same time.

A further object is a double mattress that is easy to produce at reasonable cost.

BRIEF DESCRIPTION OF THE FIGURES

Other features and advantages of the double mattress of the present invention will become clear from the following descriptions given as non-limiting examples with reference to the following figures.

DETAILED DESCRIPTION OF THE INVENTION

Figure 1:
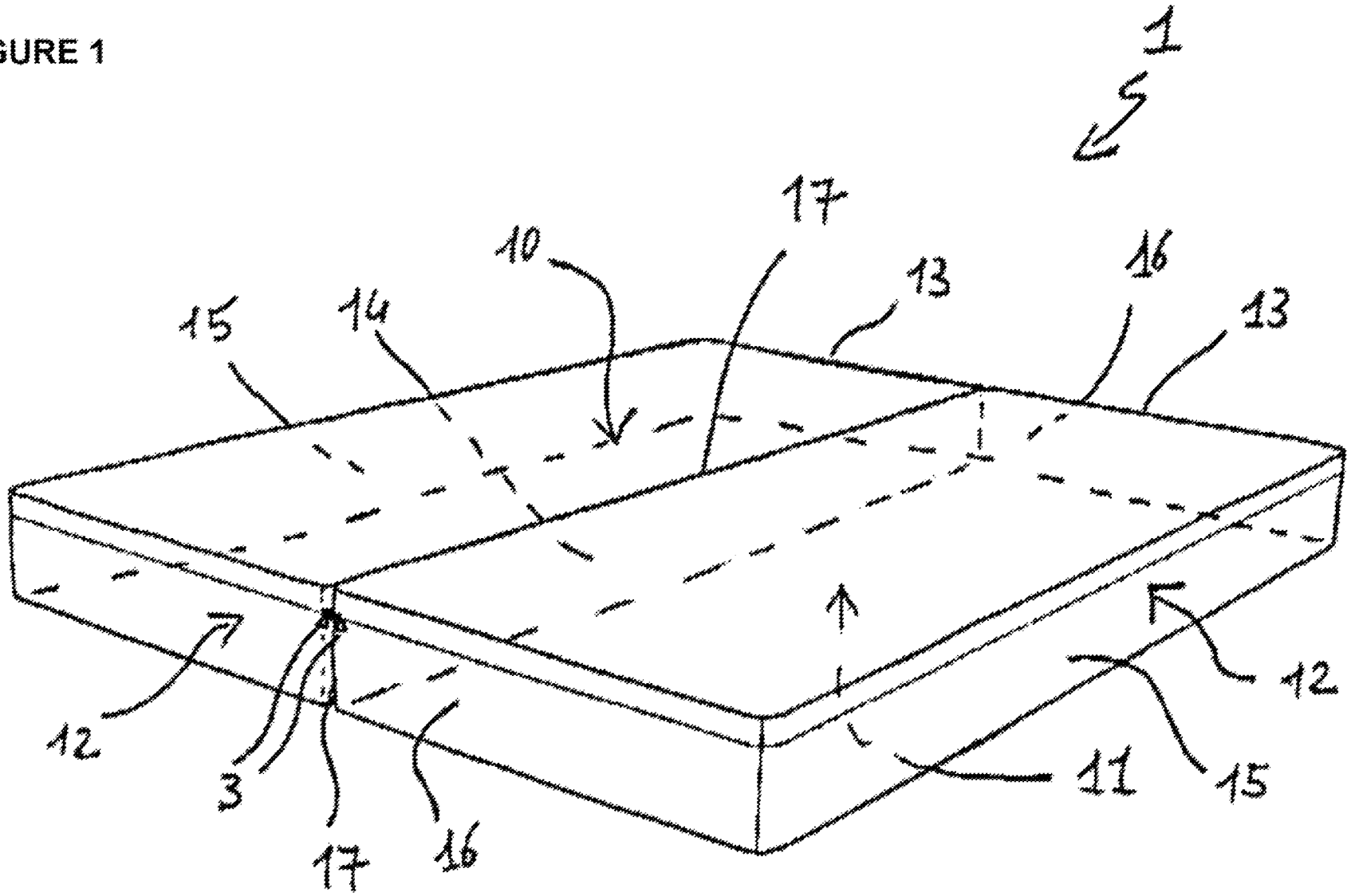
FIG. 1 shows a schematic prospective view of the mattress according to the present invention.

In FIG. 1, reference number 1 shows in general a double mattress, or side-by-side mattress. In particular, mattress 1, preferably of a quadrangular shape, has a first face (10) and a second face (11) opposite the first and linked to it with a perimeter edge (12). In particular, the perimeter edge has two longitudinal sides (15) and two transverse sides (16).

Figure 2:
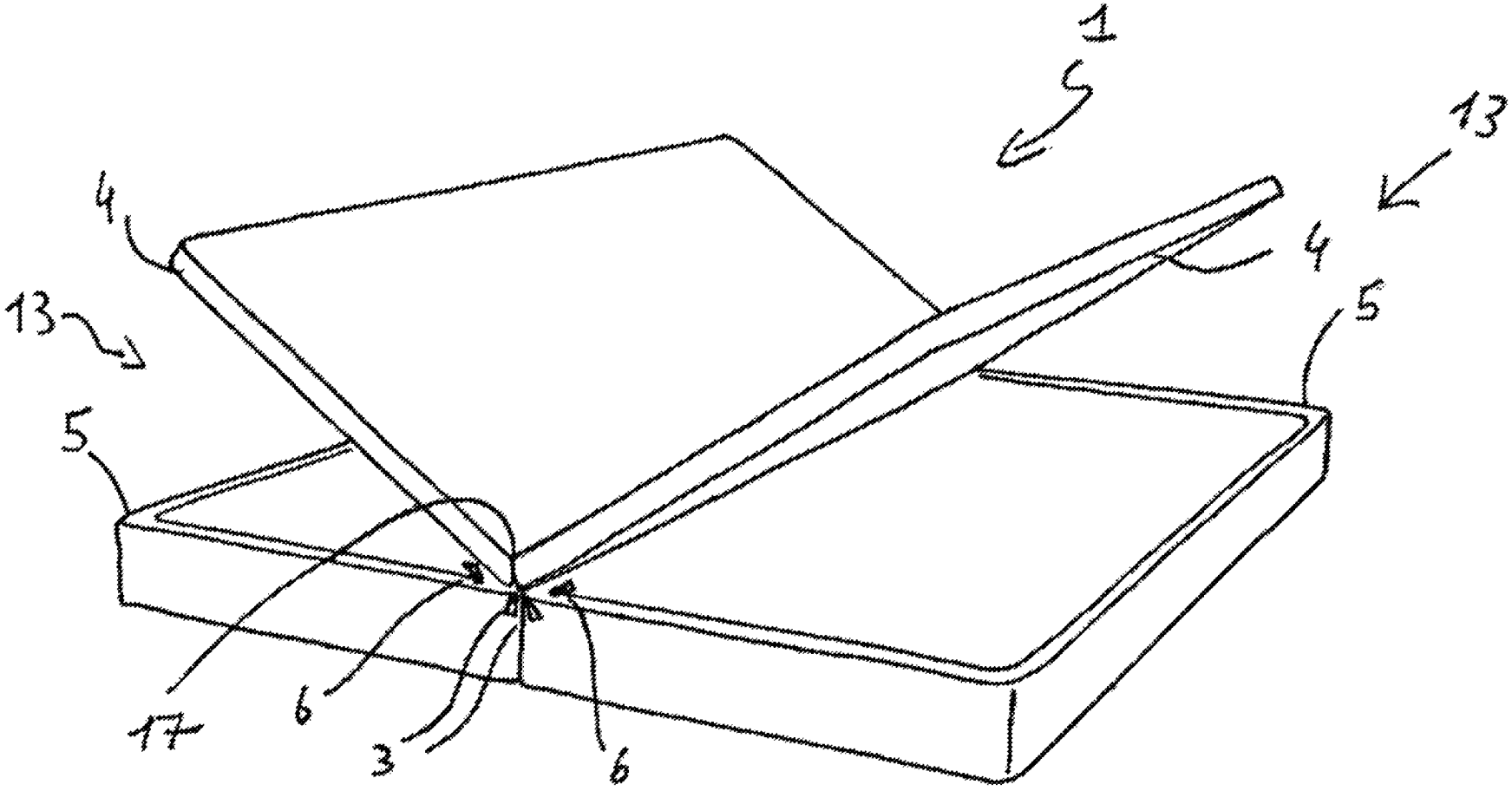
FIG. 2 shows a schematic prospective view of the mattress shown in FIG. 1 in a first assembly phase.

According to the present invention, the mattress is separated into two equal longitudinal portions (13), preferably with a corresponding seam (17) to divide the transverse sides (16) into two equal portions. In this way, the two longitudinal portions (13) lie side by side, independently and linked along a common longitudinal border (14), thereby forming a single structure. Advantageously, as better shown in FIG. 3, these two portions have a separate outer cover (2), provided with first joining means (3). Further, each cover comprises in turn its own first pocket (4) and a second pocket (5) that can be folded over each other and joined along said longitudinal edge (14) to create a book-like or butterfly-like structure that can be opened and closed by said joining means (FIG. 2). The pockets also have their own second joining means (6).

In particular, each of the two portions (13) of the mattress results from longitudinally dividing a standard double mattress into two equal parts to create two differentiable resting places or zones for two people. This advantageous separation is achieved by the provision of two covers with multiple compartments or pockets attached along a common edge, i.e. the longitudinal edge (14) described above. The two covers are preferably sewn along said edge, thus leaving the sides of the mattress free to be opened or closed.

Figure 3:
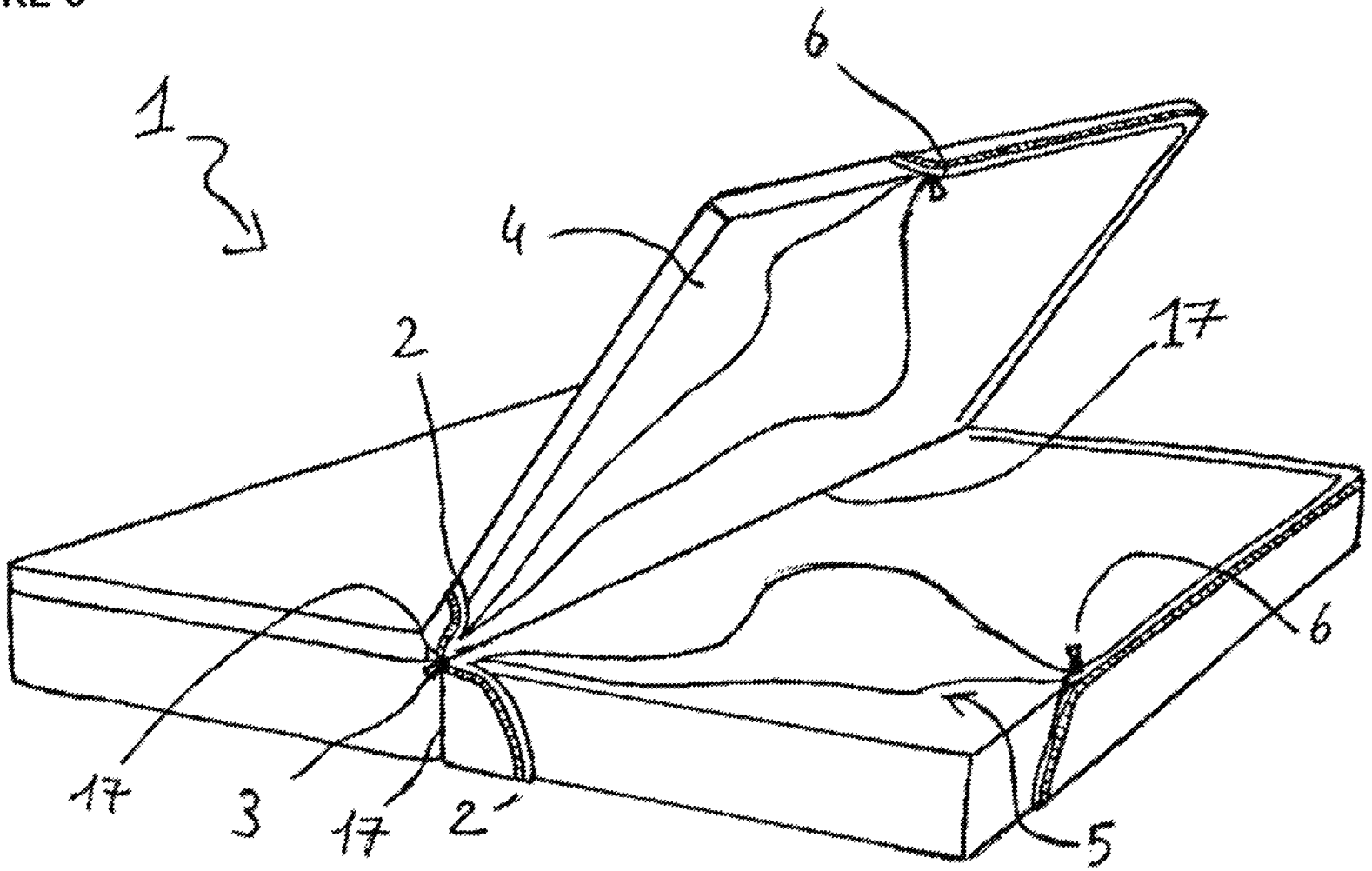
FIG. 3 shows a schematic prospective view of the mattress shown in FIG. 1 in a second assembly phase.

As a result, the mattress can be disassembled into at least four pockets: two first pockets (4), each of which can be stacked onto a second pocket (5). Thus, the two portions (13) of the double mattress are firmly joined but distinct (FIGS. 2 and 3).

Thanks to the first joining means (3) described above, the two first (4) and second (5) pockets can be separated. In fact, these means are operable along the two portions of the transverse sides (16) and the longitudinal sides (15), but, as explained above, they remain attached along the common longitudinal edge (14).

Similarly, the second joining means (6) can be moved to open the two pockets first (4) and second (5) along the same sides.

Preferably, both the first (3) and second (6) joining means of the covers (2) and the pockets 4 and 5, respectively, are conventional zippers, that is equipped with a slider operated by a pull tab or ring to join/separate two parallel rows of teeth. The rows of teeth are each held by a strip of fabric that is in turn sewn onto an edge of the cover and to the pockets, respectively.

Advantageously, according to the present invention, the two zippers (3) of the first joining means are sewn onto their respective cover (2) so it can be opened from one end of the longitudinal edge (14) of the mattress. Preferably, the zipper sliders lie close together at the same point of the longitudinal edge but placed so they run in opposite directions along the perimeter edge (12), each around its own portion (13) of the mattress, reaching the opposite end of the longitudinal edge (14), where they are stopped with conventional stopping elements (not shown).

Figure 4:
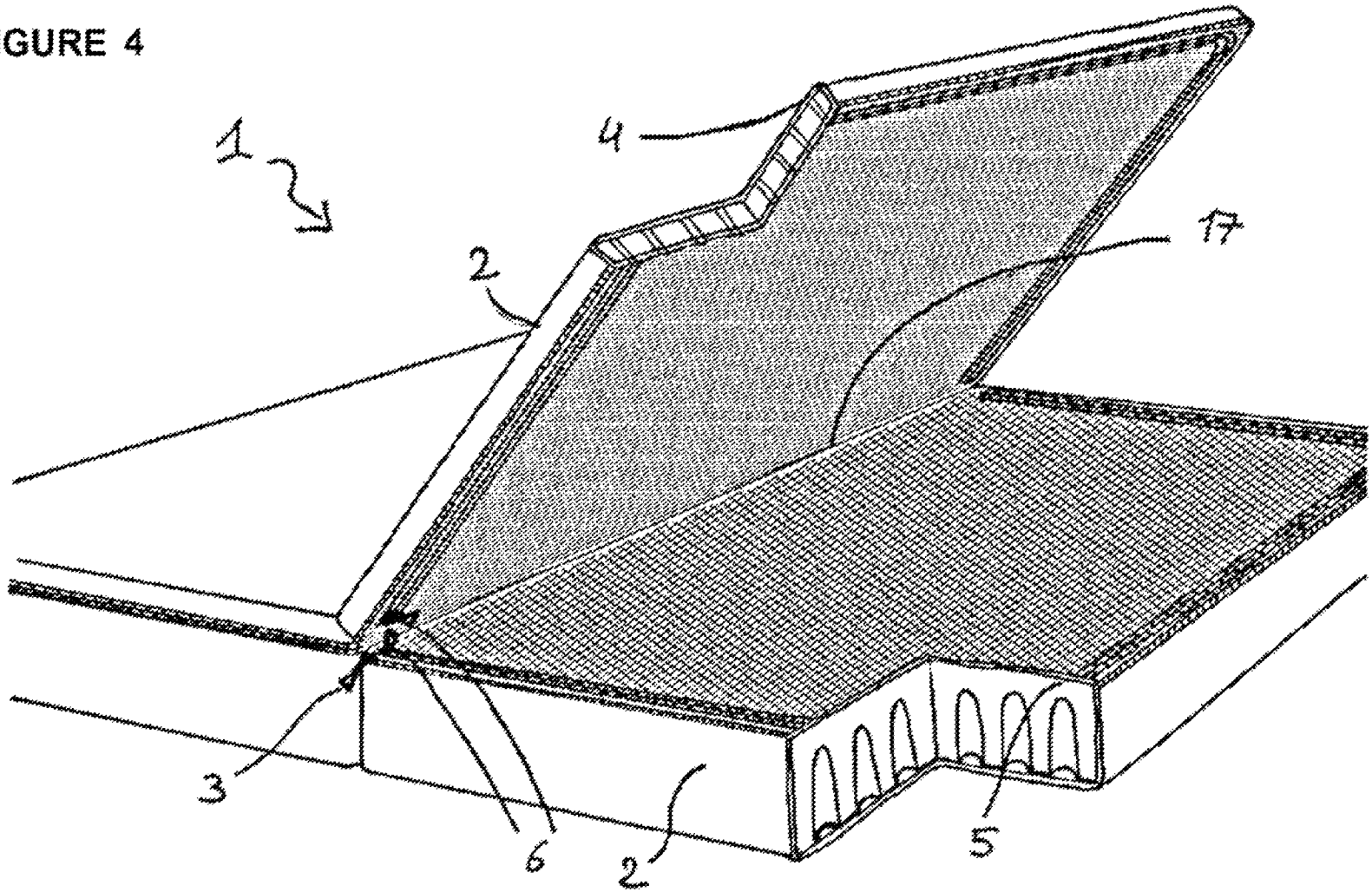
FIG. 4 shows a schematic prospective view of the mattress shown in FIG. 1 in a partially exploded view and in cross section.

In addition, as shown in the broken view of FIG. 4, both the first (4) and second (5) pockets can be of different sizes, that is they can have an inner volume in order to accommodate different amounts of the functional component or core material of the mattress. Preferably, the first pocket (4) is the one in contact with the user's body, while the second pocket (5) consists in the actual support component. In other words, the first pocket (4) may contain a functional part of the mattress that is more specifically designated for comfort, thus for retention or dispersal of the heat, or for the degree of firmness, possibly including body-shape memory. The second pocket (5) instead may contain material with varying degrees of firmness.

As a result, the first pocket (4) has preferably less volume than the second pocket (5) and, when in use, the first pocket lies above the second pocket.

The materials used for these functional components are well-known and widely available, ranging from natural materials like wool, hemp, straw, and latex, or synthetic materials like polyurethane foam. Natural materials like wool often can be combined with mechanical support systems like springs, possibly with different degrees of firmness, distributed in well-defined zones to ensure suitable support to each part of the user's body. Synthetic or latex materials are easier to modify because they can be produced with variable density or with cells or cavities that can be filled to strengthen the structure to make the mattress softer or firmer according to user needs or preferences. Additionally, the materials that come in contact with the user's body may be the same as those described above or different. For example, polyurethane and/or polyurethane foam, or memory foam, may make up a layer that can be inserted into the first pocket, in contact with the human body, to make the underlying layer, the second pocket, more comfortable.

It should be noted that each of the above-mentioned first (4) and the second (5) pockets or shells may contain a single type of material in the form of a monobloc or single layer, or a material with several separate layers, which can be of different materials, thickness, density, and firmness. That kind of structure has the advantage of creating layering, allowing for a kind of fluctuation among the various layers. It has indeed been found that fluctuation, or movement among the different layers, allows for optimal adaptation of the mattress to the user's anatomy, keeping in mind that people move while at rest, changing their contact points onto the mattress and therefore also the conditions of pressure on it. Layering also makes it easier to personalize the mattress without having to change its whole structure. Preferably, the second pocket (5) or shell, or the lower portion of the mattress, is composed of three, five-centimeter-thick layers in washable natural latex. This makes it possible to wash not only the mattress cover but also its filling to maintain always the control of the mattress hygiene.

Figure 5:
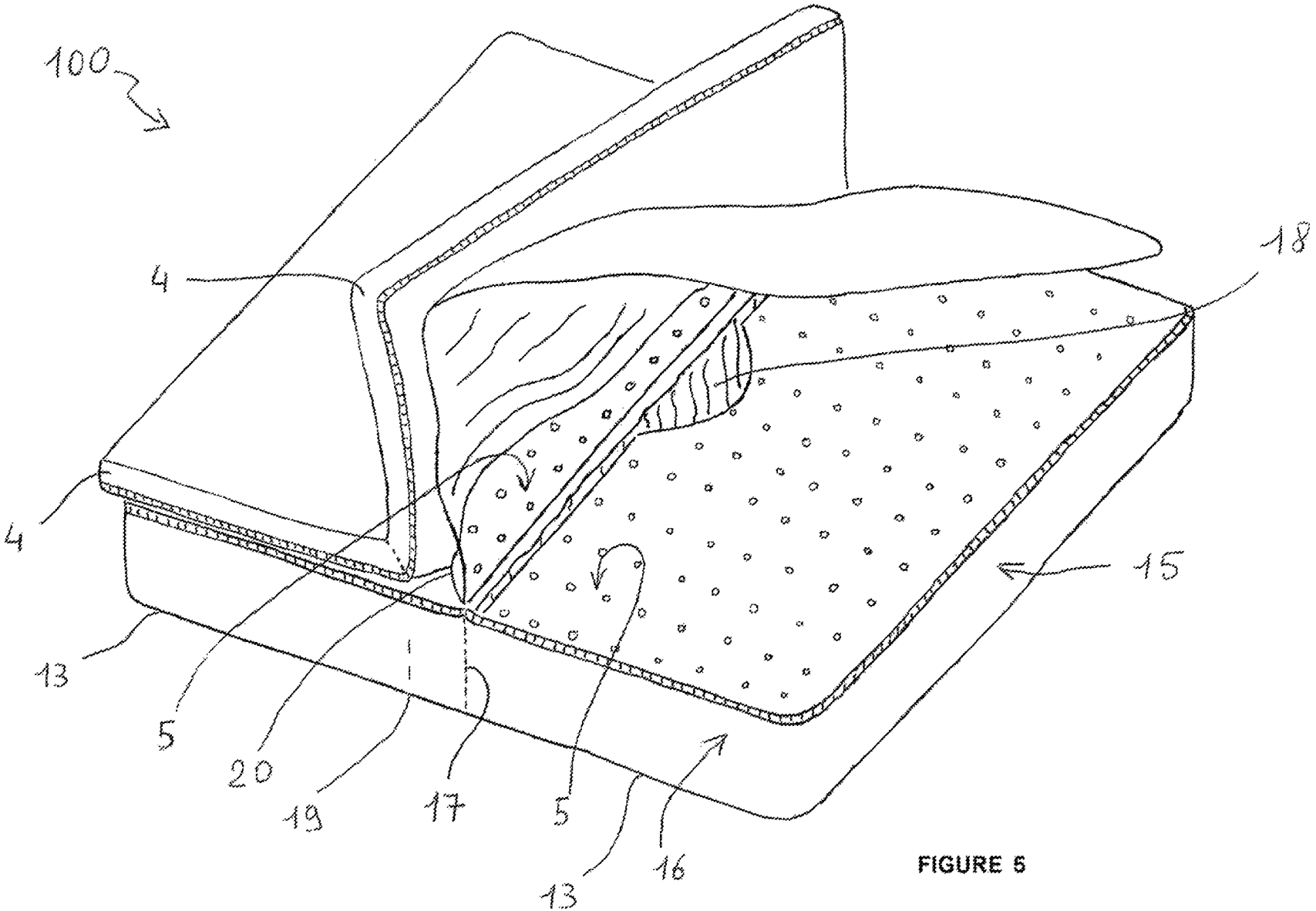
FIG. 5 shows a schematic prospective view of a variant of the mattress shown in FIG. 1 with the lower portion open.

FIG. 5 shows a variant embodiment of the invention in which mattress 100 is generally identical to the one described above, with all reference numbers identifying identical parts and elements.

In particular, mattress 100 includes a separating element (18) between the two second pockets (5) of the two portions (13), each of whose ends are sewn onto one of the two transverse sides (16) of the mattress. In this case, the two second pockets (5) have a single, continuous bottom (19). In other words, the separating element consists in the longitudinal edge (14) mentioned above, in which a first side is turned toward one second pocket (5) and a second side, opposite the first, is turned toward the other second pocket (5). As a result, each of the transverse sides (16) of the mattress appears as a single piece that shows the above-mentioned seam (17) halfway along its length to join the separating element (18).

Further, the two second pockets (5) are closed, as explained, by their respective joining means 6 (not shown), which run along first a transverse side (16), then a longitudinal side (15) and finally the other transverse side (16), where they stop, as explained above. FIG. 5 shows how a seam (20) joins the two first pockets (4) with the two second pockets (5) at the separating element (18), without completely separating the two second pockets from each other. In other words, the two second pockets (5) are opened on the side opposite the base. The seam (20) therefore separates only the first (4) and second (5) pockets from each other and links them only at each of the two transverse sides (16) of the mattress.

Figure 6:
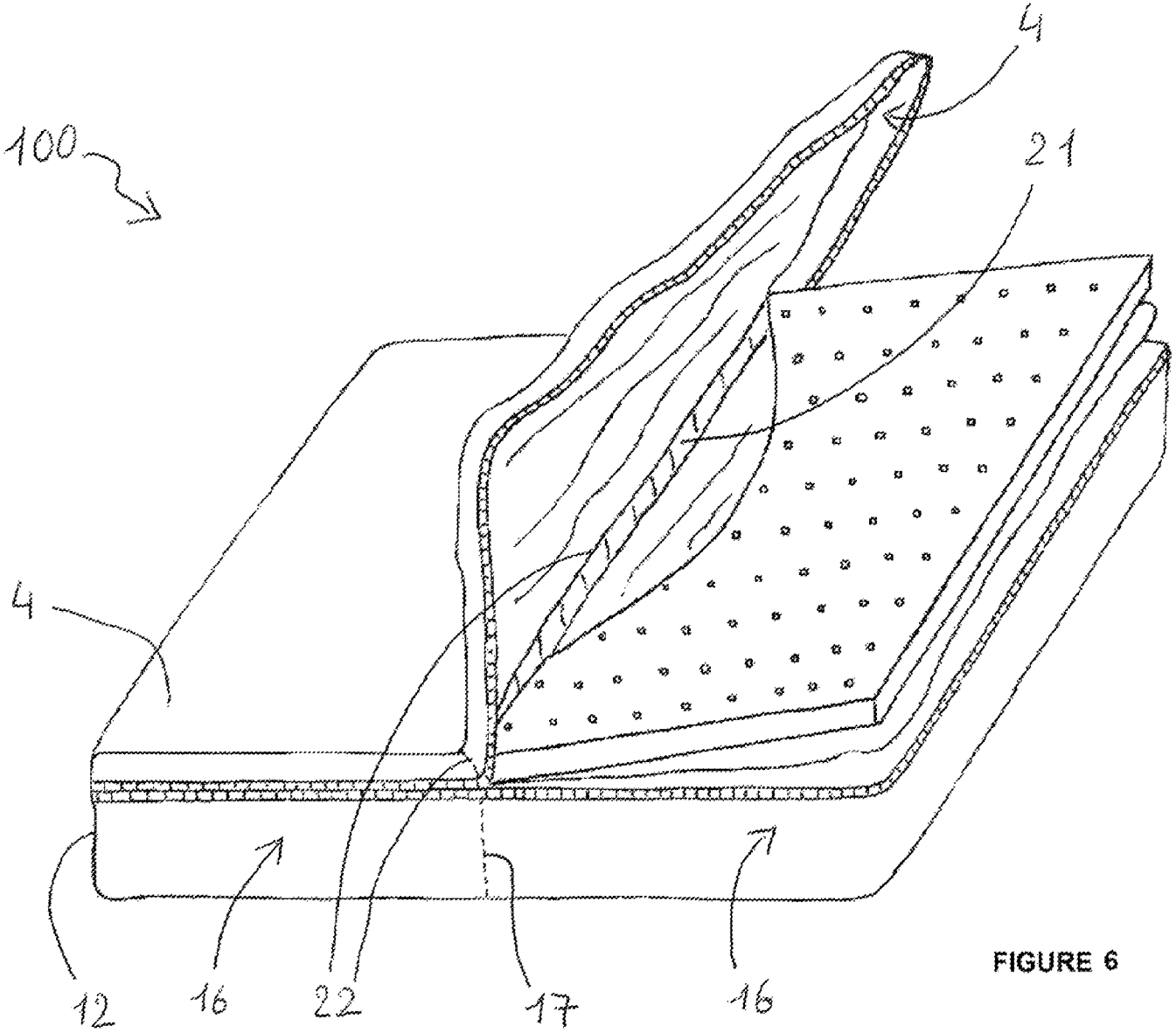
FIG. 6 shows a schematic prospective view of the mattress in FIG. 5 with an upper portion open.

FIG. 6 shows mattress 100 with an open first pocket (4). Here as well, the reference numbers are the same as those used above and show the same elements or parts. In particular, also the two first pockets (4) or upper pockets are separated by a separating element (21), which in this case completely separates the two pockets. The separating element (21) is thus sewn onto the cover of the pockets so that they are completely separated, as demonstrated by the seam (22).

According to a further embodiment, which is not illustrated, the mattress of the invention can also have the second pockets (5) completely separated along the longitudinal edge (14) and joined only by the seam (17) that constitutes the link line between the first (4) and second (5) pockets. In this way, each section (13) of the mattress will have another distinct longitudinal side and a distinct bottom.

In other words, two clearly distinct portions (13) are formed and solidly and permanently joined only along this seam line so there is a kind of hinge that allows the two portions (13) to be independent but joined and, thanks to said joining means (3), also enables the first (4) and second (5) pockets to be independent and to be opened separately by their respective joining means (6).

The structure just described allows for the insertion into the first (4) and second (5) pockets on each portion (13) of the mattress (1) a wide range of materials so the mattress can be adapted specifically to the needs and the anatomy of both users of the double mattress.

In fact, thanks to the "book-like" structure, the first and second pockets of each portion can be opened individually and filled with the material needed to provide an actually personalized product, without having to produce individual double mattresses already prepared.

This means a significant reduction in production and storage volumes with a corresponding lowering of production costs.

The simple arrangement of a double mattress means that its structure can be adapted at any time to accommodate unexpected morphological/physiological changes in just one of the two users of the mattress without having to change it completely.

This makes it possible to provide fast and economical service even in case of a user's sudden weight gain.

This description shows how the problems mentioned in the introduction have been resolved and significant improvements have been achieved.

The mattress according to the present invention as described above may however undergo modifications and variants without jeopardizing the invention's scope of protection as defined by the claims listed below.

For example, both the first and second joining means may consist of a Velcro tape, a series of snaps or a combination of the two.

The two portions (13) of the double mattress may be separated using joining means that are identical to those described above provided along the longitudinal edge (14) beside them.

The cover (2) with its first (4) and second (5) pockets may be of any washable and breathable fabric to enhance comfort.

The invention claimed is:

1. A double mattress having a quadrangular shape, the mattress comprising:

a first face and a second face opposing said first face by an interposition of a perimeter edge having two longitudinal sides and two transverse sides, wherein the mattress is divided into two portions placed side by side, the two portions together forming the first face and the second face, the two portions being independent and joined along a common longitudinal edge, the two portions being each encased by a cover with first joining means, each cover being provided with at least two pockets, the at least two pockets including a first pocket and a second pocket, the first pocket being configured to be (i) placed upon the second pocket, and (ii) joined along the common longitudinal edge to the second pocket in a way that creates a book-like structure, the at least two pockets having respective second joining means.

2. The double mattress according to claim 1, wherein the two portions are joined by a seam.

3. The double mattress according to claim 1, wherein the first pocket is superimposed onto the second pocket.

4. The double mattress according to claim 3, wherein both the first pockets and second pockets of each portion of the mattress are separated by a separating element.

5. The double mattress according to claim 4, wherein the second pockets have a single, continuous bottom.

6. The double mattress according to claim 2, wherein the two portions are completely independent by means of the seam along the common longitudinal edge.

7. The double mattress according to claim 2, wherein the two portions are totally distinct and joined integrally and permanently only along a line of connection corresponding to the seam to form a hinge that allows the first and second pockets to be independent and opened separately using the respective second joining means.

8. The double mattress according to claim 1, wherein the first and/or second joining means are selected from zippers, hook and loop bands, and snaps.

9. The double mattress according to claim 1, wherein the first joining means are two zippers, each of which is attached along the perimeter edge of the respective portion with sliders that are aligned side by side and that are running (i) in opposite directions of one of the transverse sides of the perimeter edge and (ii) from one end of a respective longitudinal edge of the perimeter edge to the other end of the respective longitudinal edge of the perimeter edge.

10. The double mattress according to claim 1, wherein the first pocket (i) is above the second pocket and (ii) has a smaller volume than that of the second pocket.

11. The double mattress according to claim 1, wherein the first pocket is adapted to contain natural or synthetic material that is configured to retain or disperse body heat, and/or a body-shape-memory material.

12. The double mattress according to claim 1, wherein the second pocket is adapted to contain natural or synthetic material selected from wool, hemp, straw, latex, or polyurethane.

13. The double mattress according to claim 1, wherein the first and/or second pockets are filled with a multilayered material in order to achieve a fluctuating effect among the layers of the multilayered material.

* * * * *